US007104408B2

(12) United States Patent
Stravitz

(10) Patent No.: US 7,104,408 B2
(45) Date of Patent: Sep. 12, 2006

(54) MULTI-LEVEL SORTER/ORGANIZER WITH OPTIONAL INTERMEDIATE COMPARTMENT

(76) Inventor: David M. Stravitz, 16 Park Ave.-Suite 14A, New York, NY (US) 10016

( * ) Notice: Subject to any disclaimer, the term of this patent is extended or adjusted under 35 U.S.C. 154(b) by 281 days.

(21) Appl. No.: 10/702,206

(22) Filed: Nov. 4, 2003

(65) Prior Publication Data

US 2005/0092699 A1 May 5, 2005

(51) Int. Cl.
*B42F 17/00* (2006.01)

(52) U.S. Cl. ..... 211/11; 211/55; 211/126.13

(58) Field of Classification Search ..... 211/10, 211/11, 55, 50, 126.13, 52, 128.1; D19/90; 206/371

See application file for complete search history.

(56) References Cited

U.S. PATENT DOCUMENTS 85,367 A * 12/1868 Collins ..... 211/55
1,045,317 A * 11/1912 Musil ..... 211/55
1,331,682 A 2/1920 Smith
D55,077 S * 5/1920 Page ..... D19/90
2,067,051 A * 1/1937 Hall ..... 211/55
D241,136 S 8/1976 Ellis et al.
4,228,904 A 10/1980 Dumond
D269,574 S 7/1983 Doüugherty
D277,969 S 3/1985 Bustos
D306,040 S 2/1990 Evenson
5,344,030 A 9/1994 Evenson
5,447,242 A * 9/1995 Kelly et al. ..... 211/42
D381,362 S 7/1997 Meyer
D390,268 S 2/1998 Stravitz
5,826,730 A 10/1998 Stravitz
D411,399 S 6/1999 Stravitz
D413,749 S 9/1999 Stravitz
D421,687 S 3/2000 Curci
D432,576 S 10/2000 Stravitz
D432,578 S 10/2000 Stravitz
D433,432 S * 11/2000 Prather et al. ..... D16/202
D451,744 S 12/2001 Stravitz
D452,976 S 1/2002 Carpenter
D453,276 S 2/2002 Stravitz
D459,398 S 6/2002 Stravitz
D494,625 S 8/2004 Stravitz
D495,007 S 8/2004 Stravitz (Continued)

OTHER PUBLICATIONS

U.S. Appl. No. 29/192,912, filed Oct. 31, 2003; David M. Stravitz (inventor); Multi-Level Sorter With Center Compartment and Open Ends.

*Primary Examiner*—Jennifer E. Novosad
(74) *Attorney, Agent, or Firm*—Frishauf, Holtz, Goodman & Chick, P.C.

(57) ABSTRACT

Sorter/organizer for file folders or other objects, includes at least three planar walls arranged parallel to one another and including a front wall, a rear wall and at least one dividing wall arranged between the front and rear walls. Side walls are connected to the three walls with each having a lower edge coplanar with a lower edge of the front wall and arranged to enable a bottom of the compartments to be positioned at varied heights. A first stepped bottom wall is connected to the three walls and to at least one side wall such that at least two compartments receivable of objects and staggered in relation to one another are formed. At least one side wall has upper edge portions connected to the first bottom wall. Ledges extend above the upper edge portions of the side walls and alongside a bottom of a respective compartment.

23 Claims, 9 Drawing Sheets

U.S. PATENT DOCUMENTS

D497,391 S 10/2004 Stravitz
D502,221 S * 2/2005 Chen et al. ..... D19/90
D502,741 S * 3/2005 Bain ..... D19/90

* cited by examiner

MULTI-LEVEL SORTER/ORGANIZER WITH OPTIONAL INTERMEDIATE COMPARTMENT

FIELD OF THE INVENTION

The present invention relates generally to a multi-level sorter/organizer and more particularly to multi-level sorter/organizers for storing file folders and the like which include compartments enabling sorting and organizing of the file folders and optionally storage of envelopes and the like.

BACKGROUND OF THE INVENTION

Organizers for storing and organizing file folders to be held on a desk are well-known. Specifically, organizers for storing and organizing file folders and other papers are known which include a one-piece molded member having a plurality of vertically oriented compartments which receive the file folders. Throughout the following specification, "file folders" are referred to for convenience. However the invention is also useful for sorting/organizing/storing other items such as papers, booklets, pamphlets, pictures and any other similar objects.

Generally, these known organizers can be grouped into three different groups.

A first group includes organizers having compartments of equal height, so that the file folders are stored one behind the other. However, with such organizers, it becomes difficult to view labels provided on the rearmost file folders, and therefore, it becomes necessary to remove the file folders from the organizer in order to determine the subject matter of the rearmost file folders. This is because the label portion of one file folder will generally block the view of the label on a rearwardly adjacent file folder when the file folders are all at the same height.

A second group includes organizers having compartments of differing heights with larger compartments placed behind smaller compartments, thereby providing a staggered relation of compartments. However, there is no stepped relation between the compartments. Rather, larger file folders and papers are placed in the larger, rear compartments and extend to a height higher than the shorter folders and papers in the forward compartments. However, if file folders of the same height are used, the file folders will be difficult to access from the rear compartments, and in addition, the same disadvantages of the first group of organizers would also apply.

A third group includes organizers having compartments which are of the same height but staggered in height relative to each other by means of steps. In the past, such organizers were not able to support themselves on a desk because of the stepped arrangement and thus were typically limited to being mounted to walls. However, the inventor, in U.S. Pat. No. 5,826,730 incorporated by reference herein, describes an organizer of this type with compartments having substantially the same height and wherein the compartments are staggered in height relative to each other and wherein the organizer can be stably supported on a desk or other flat surface.

Specifically, the '730 patent describes a file folder organizer including a front wall, a rear wall and side walls connecting the front and rear walls together in parallel, spaced apart relation and such that a lower edge of the rear wall is raised relative to a lower edge of the front wall and an upper edge of the rear wall is raised relative to an upper edge of the front wall. Lower edges of the side walls and the front wall are substantially coplanar to enable the organizer to be supported on a horizontal surface in a vertical orientation. A bottom wall connects the lower edges of the front and rear walls. The bottom wall has steps of different heights which are parallel and offset from each other in a heightwise and depthwise direction of the organizer. The bottom wall is at least partially enclosed by the side walls so that the side walls hide the steps of the bottom wall. Lengthwise and transverse dividing walls divide an area bounded by the front, rear and side walls into a plurality of compartments, at least two of which are closed at a bottom thereof by different steps of the bottom wall so as to provide a staggered relation to the compartments.

The presence of the side walls and transverse dividing wall(s) limits the size of file folders and similar objects which may be placed into the compartments. That is, since the length of each compartment has a length defined by one of the side walls and a transverse dividing wall (or possibly two transverse dividing walls when multiple transverse dividing walls are present), a file folder which is longer than the length of the compartment cannot be placed into the compartment.

It would therefore be advantageous to provide a file folder organizer in which there is no limitation on the length of a file folder which can be placed in compartments of the organizer.

OBJECTS AND SUMMARY OF THE INVENTION

Accordingly, it is an object of the present invention to provide new and improved sorter/organizers having compartments for storing file folders.

Another object of the present invention is to provide new and improved sorter/organizers having compartments for storing file folders and other objects which do not limit the size of the file folders or other objects which can be placed into the compartments.

Yet another object of the present invention is to provide new and improved sorter/organizers having open-sided compartments for storing file folders and other objects and which are designed to prevent the file folders and other objects from falling out of the compartments.

It is another object of the present invention to provide new and improved sorter/organizers having compartments for storing file folders and other objects which have substantially the same height and which are staggered in height relative to one another.

It is another object of the present invention to provide new and improved sorter/organizers having compartments for storing file folders and other objects which can be supported on a desk and other flat surfaces and preferably can also be mounted to a wall or other vertical surface.

It is still another object of the present invention to provide an sorter/organizer for storing file folders and other objects that provides a staggered relation to equal-size file folders, and which can also sit on a desk.

It is still another object of the present invention to provide a file folder sorter/organizer in which the stepped arrangement for staggering is hidden from view by the support for the file folder sorter/organizer.

In accordance with an aspect of the present invention, a file folder sorter/organizer includes at least three substantially planar walls arranged parallel to one another and including a front wall, a rear wall and at least one dividing wall arranged between the front and rear walls, and side walls connected to the planar walls and extending between the front and rear walls. Each side wall has a lower edge coplanar with a lower edge of the front wall and is arranged to position a bottom of the compartments at varied heights. A stepped bottom wall is connected to the planar walls and side walls such that at least two compartments capable of receiving file folders or the like are formed in a staggered relation to one another. Both side walls have upper edge portions connected to the bottom wall. Ledges extend above the upper edge portions of the side walls and alongside a bottom of a respective compartment. The ledges extend only partially toward upper edges of the planar walls such that at least one side of the compartments is open above the ledges.

With this structure, open compartments in a staggered relationship are provided, and yet a retaining structure is provided to prevent inadvertent removal or slipping of the file folders out of the compartments.

It is conceivable that the ledges can be formed at only one edge of the planar walls, in which case, the side wall at the other edge of the planar walls can close the compartments. This would be the case when a transverse dividing wall is provided to transversely partition the compartments between the front and rear walls.

The bottom wall may include bottom panels arranged at different heights and closure panels connecting adjacent bottom panels. Each bottom panel defines a bottom support surface of a respective compartment. The ledges are therefore arranged alongside the bottom panels.

In the embodiment wherein the bottom wall is connected to both side walls, i.e., the compartments are defined by the bottom wall and between the side walls, the rear wall may include a compartment-defining portion and support portions each arranged below the compartment-defining portion and contiguous with a respective side wall. A lower edge of each support portion is may be co-planar with the lower edges of the front wall and the side walls. The compartment-defining portion has a lower edge staggered or raised with respect to a lower edge of the front wall and an upper edge raised relative to an upper edge of the front wall.

In one embodiment, reinforcing ribs are arranged at the outer edge(s) on at least one side of each planar wall and contiguous with a side wall and the ledges. The reinforcing ribs would thus have a surface coplanar with an outer surface of the side wall. The reinforcing ribs extend inward from each planar wall toward an opposed planar wall. As such, the outer edges of the front and rear walls are provided with an L-shaped reinforcing structure while the outer edges of any dividing walls are provided with a T-shaped reinforcing structure.

Another embodiment of a file folder sorter/organizer in accordance with the invention comprises a substantially planar front wall including first and second spaced-apart front wall portions, a substantially planar rear wall arranged parallel to the front wall, at least one first dividing wall arranged between the first front wall portion and the rear wall, at least one second dividing wall arranged between the second front wall portion and the rear wall, a first, stepped bottom wall connected to the first front wall portion, the first dividing wall(s) and the rear wall such that at least two compartments capable of receiving file folders or the like are formed and which are staggered in relation to one another, a second, stepped bottom wall connected to the second front wall portion, the second dividing wall(s) and the rear wall such that at least two compartments receivable of file folders are formed and which are staggered in relation to one another, a first side wall connected to an outer edge of the first front wall portion, an outer edge of the first dividing wall(s) and an outer edge of the rear wall, and a second side wall connected to an outer edge of the second front wall portion, an outer edge of the second dividing wall(s) and an outer edge of the rear wall. The first side wall has upper edge portions connected to the first bottom wall and a lower edge coplanar with a lower edge of the front wall and is arranged to position a bottom of the compartments defined in part thereby at varied heights. The second side wall has upper edge portions connected to the second bottom wall and a lower edge coplanar with the lower edge of the front wall and is arranged to position a bottom of the compartments defined in part thereby at varied heights. A first transverse wall is connected to the first bottom wall and the first front wall portion and extends rearward from an inner edge of the first front wall portion. A second transverse wall is connected to the second bottom wall and the second front wall portion and extends rearward from an inner edge of the second front wall portion. The second transverse wall is spaced from the first transverse wall to define a storage compartment therebetween in which envelopes, writing utensils and the like can be stored.

As in the preceding embodiment, ledges may be formed extending above the upper edge portions of the first and second side walls and alongside a bottom of a respective compartment. The first and second transverse walls are preferably parallel to the side walls and may connect the respective front wall portions to the rear wall. In the alternative, the transverse walls extend only part of the distance from the front wall portions to the rear wall. A planar bottom wall may be arranged between the transverse walls to define a bottom of the storage compartment.

The bottom walls may have the same structure as described in the preceding embodiment. Further, the reinforcing ribs described above may be provided in this embodiment as well to reinforce the outer edges of the front wall portions, the rear wall and the first and second dividing walls.

The above and other objects, features and advantages of the invention will become readily apparent from the following detailed description thereof which is to be read in connection with the accompanying drawings.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 7:
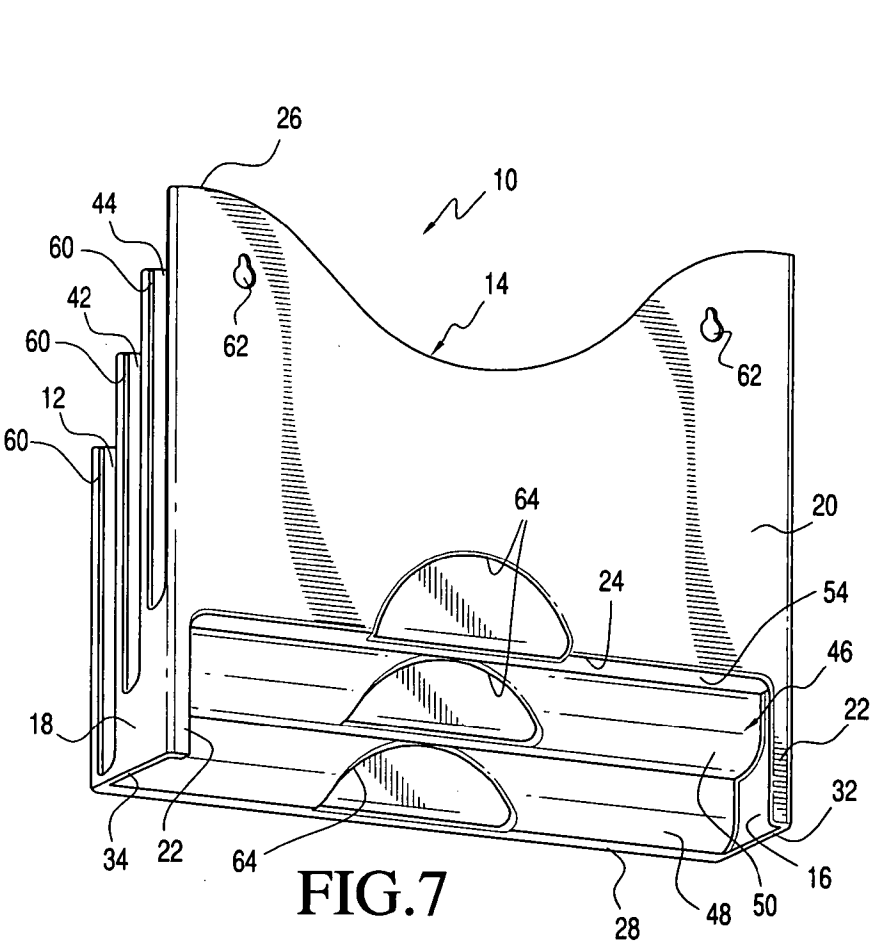
FIG. 7 is a rear, perspective view of the file folder sorter/organizer shown in FIG. 1.
Figure 1:
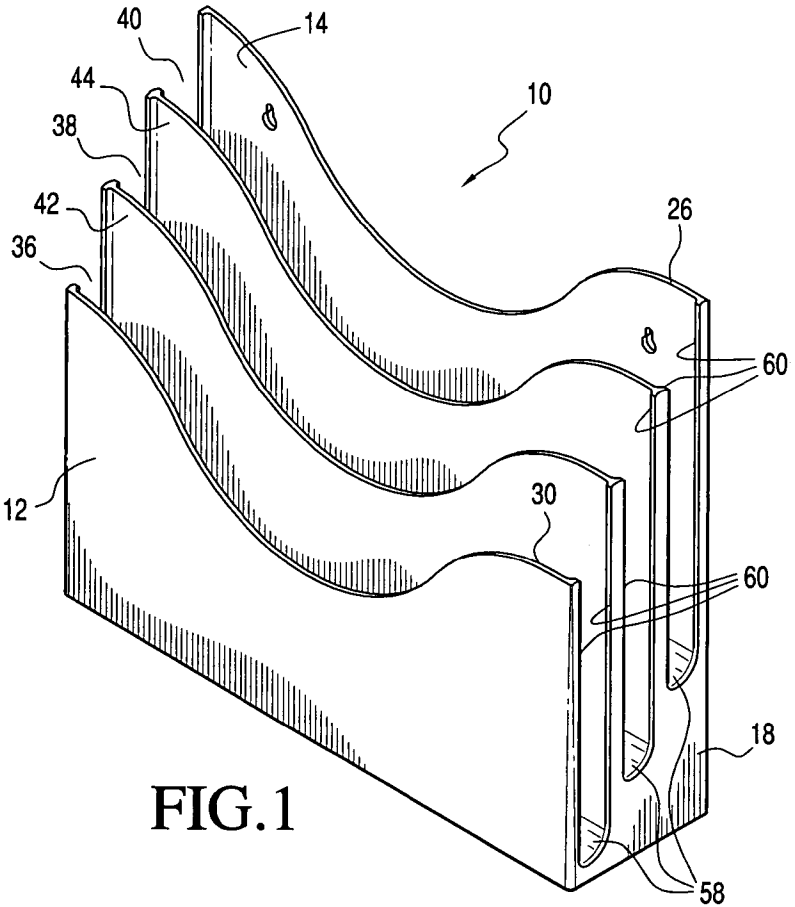
FIG. 1 is a front, perspective view of a first embodiment of a file folder sorter/organizer according to the present invention shown in a vertical position in which it could be used resting on a horizontal surface, such as a desk or table top, and/or placed against a wall.
Figure 2:
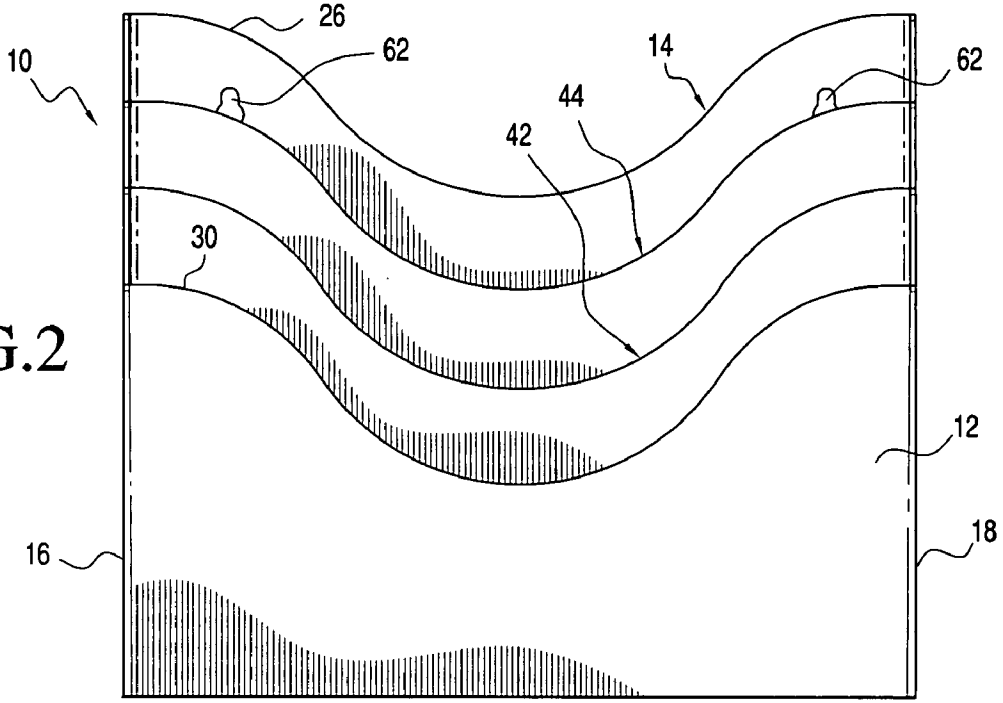
FIG. 2 is a front elevational view of the file folder sorter/organizer shown in FIG. 1.
Figure 3:
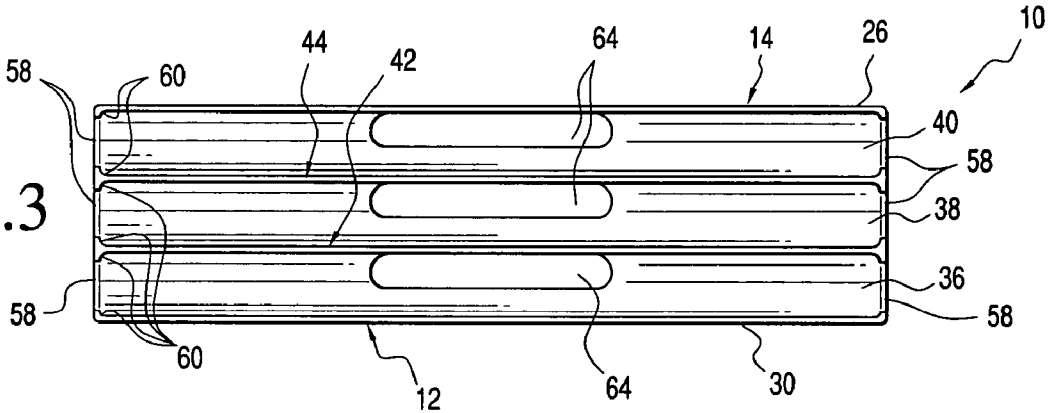
FIG. 3 is a top plan view of the file folder sorter/organizer shown in FIG. 1.
Figure 4:
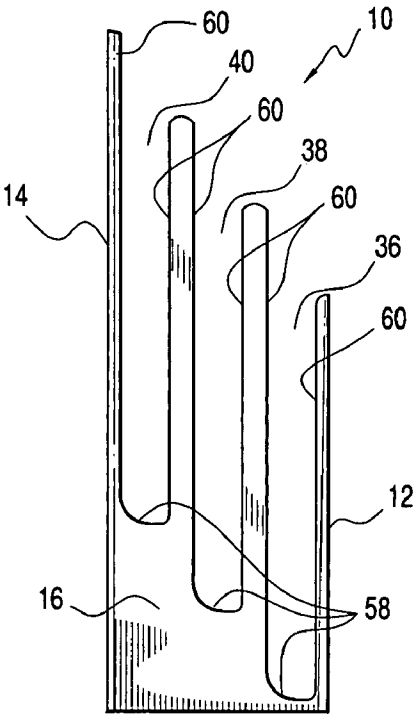
FIG. 4 is a left side elevational view of the file folder sorter/organizer shown in FIG. 1, the right side elevational view being a mirror image thereof.
Figure 5:
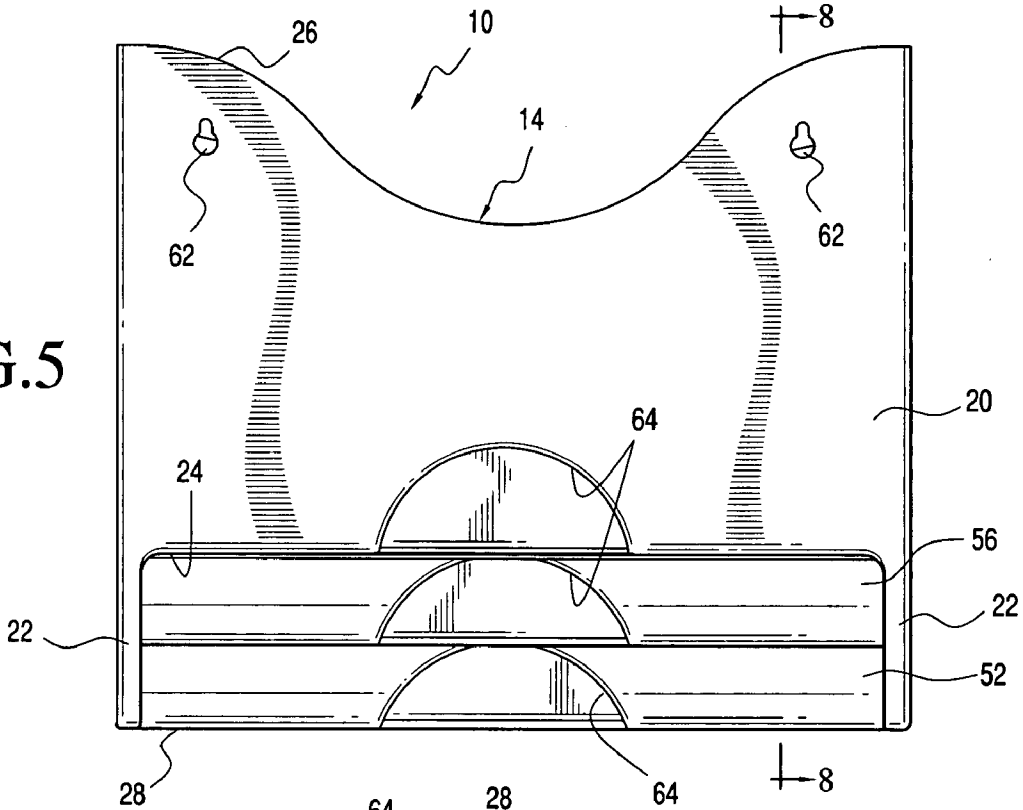
FIG. 5 is a rear elevational view of the file folder sorter/organizer shown in FIG. 1.
Figure 6:
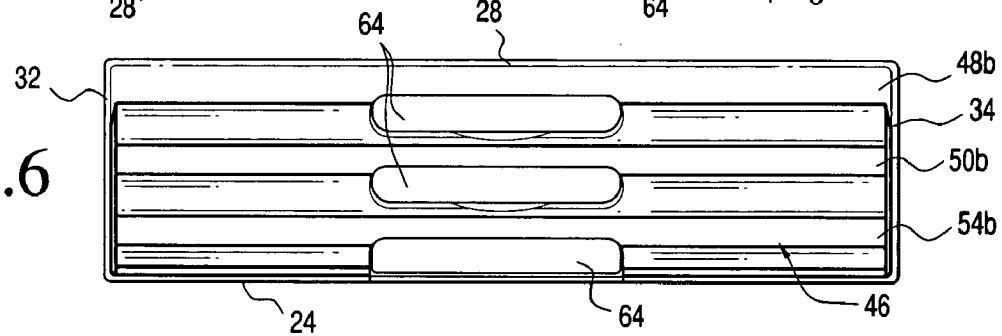
FIG. 6 is a bottom plan view of the file folder sorter/organizer shown in FIG. 1.

Referring to the accompanying drawings wherein like reference numerals refer to the same or similar elements, a first embodiment of a file folder sorter/organizer according to the present invention (see FIGS. 1–8) is designated generally as 10 and includes a substantially planar front wall 12, a substantially planar rear wall 14 and two side walls 16 and 18 which connect front wall 12 and rear wall 14 together in parallel, spaced apart relation. The rear wall 14 has a compartment-defining portion 20 and support portions 22 arranged below the compartment-defining portion 20 and contiguous with the side walls 16,18. Support portions 22 are optional but when present, provide further support for the sorter/organizer 10 when used in a vertical orientation (as discussed below) and also reinforce or strengthen the side walls 16, 18.

The compartment-defining portion 20 of the rear wall 14 has a lower edge 24 staggered or raised with respect to a lower edge 28 of the front wall 12, for example, by about 3 inches relative to the lower edge 28 of the front wall 12, and its upper edge 26 also raised relative to the upper edge 30 of front wall 12. The actual distance between the lower edge 24 of the compartment-defining portion 20 and the lower edge 28 of the front wall 12 depends on the number of compartments defined therebetween.

The lower edge of the support portions 22 of the rear wall 14, the lower edge 28 of the front wall 12 and the lower edges 32, 34 of the side walls 16, 18 are substantially flat and coplanar to enable the sorter/organizer 10 to securely rest on a desktop, or other flat surface, when vertically oriented thereon. To provide further support for the sorter/organizer in a vertical orientation, it is possible to position the sorter/organizer 10 with the rear wall 14 against a vertical surface such as a wall. This provides further stability to the sorter/organizer 10, but it still remains possible to use the sorter/organizer 10 in a free standing position without placing it against a vertical wall or other vertical surface.

The area between front and rear walls 12 and 14 is divided into a plurality of compartments 36, 38, 40, by substantially planar dividing walls 42, 44. Specifically, two parallel, spaced apart widthwise dividing walls 42 and 44 extend between front and rear walls 12 and 14 and in parallel relation thereto. Compartment 36 is thus defined between the front wall 12 and dividing wall 42, compartment 38 is defined between the dividing wall 42 and the dividing wall 44 and compartment 40 is defined between the dividing wall 44 and the rear wall 14. Although the illustrated embodiment shows two dividing walls 42, 44, it is of course possible to provide any number of dividing walls between the front and rear walls 12, 14, for example, only one dividing wall in which case two compartments would be formed or three dividing walls in which case four compartments would be formed.

Figure 8:
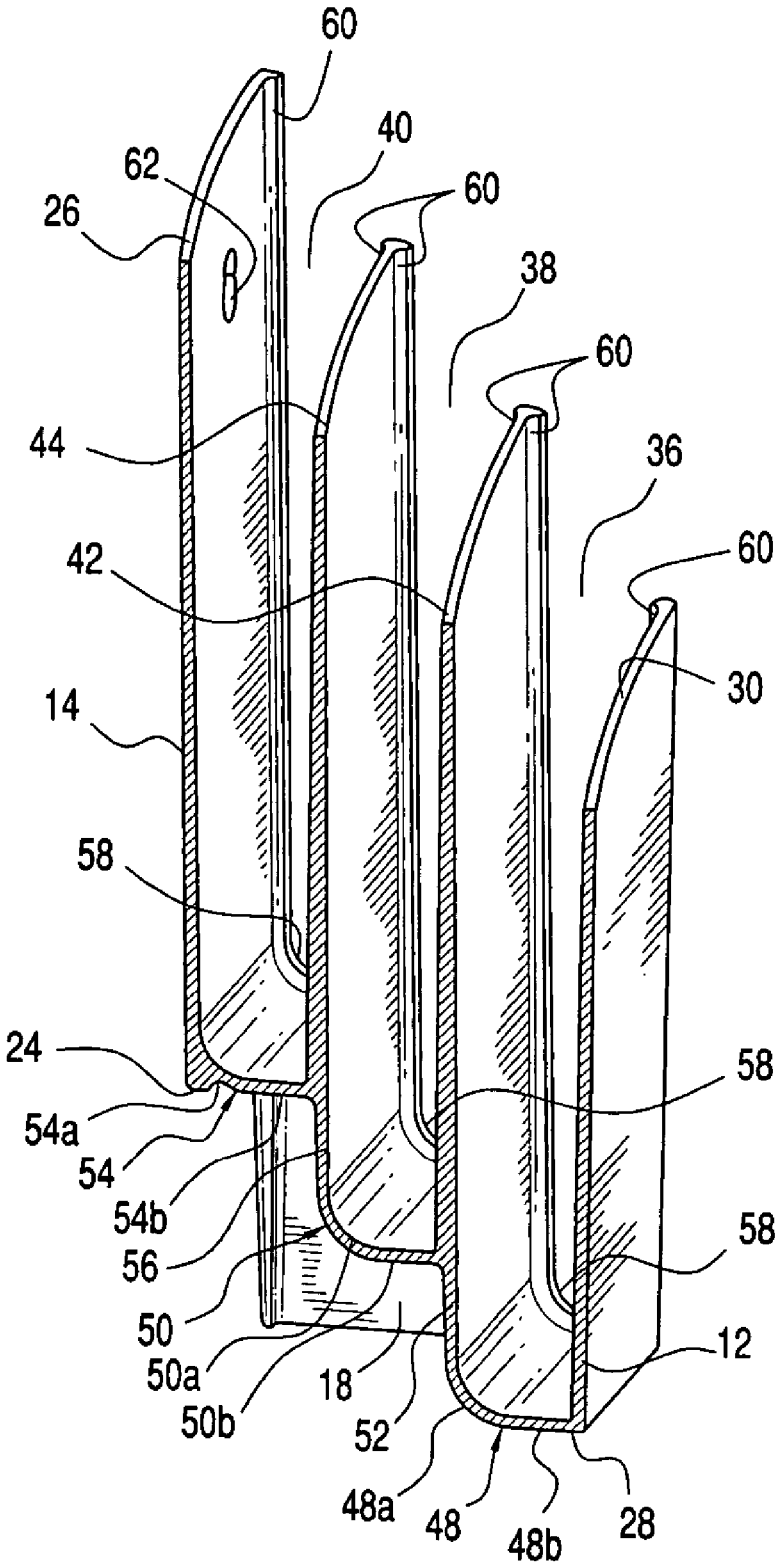
FIG. 8 is a cross-sectional, perspective view taken along the line 8—8 in FIG. 5.
Figure 9:
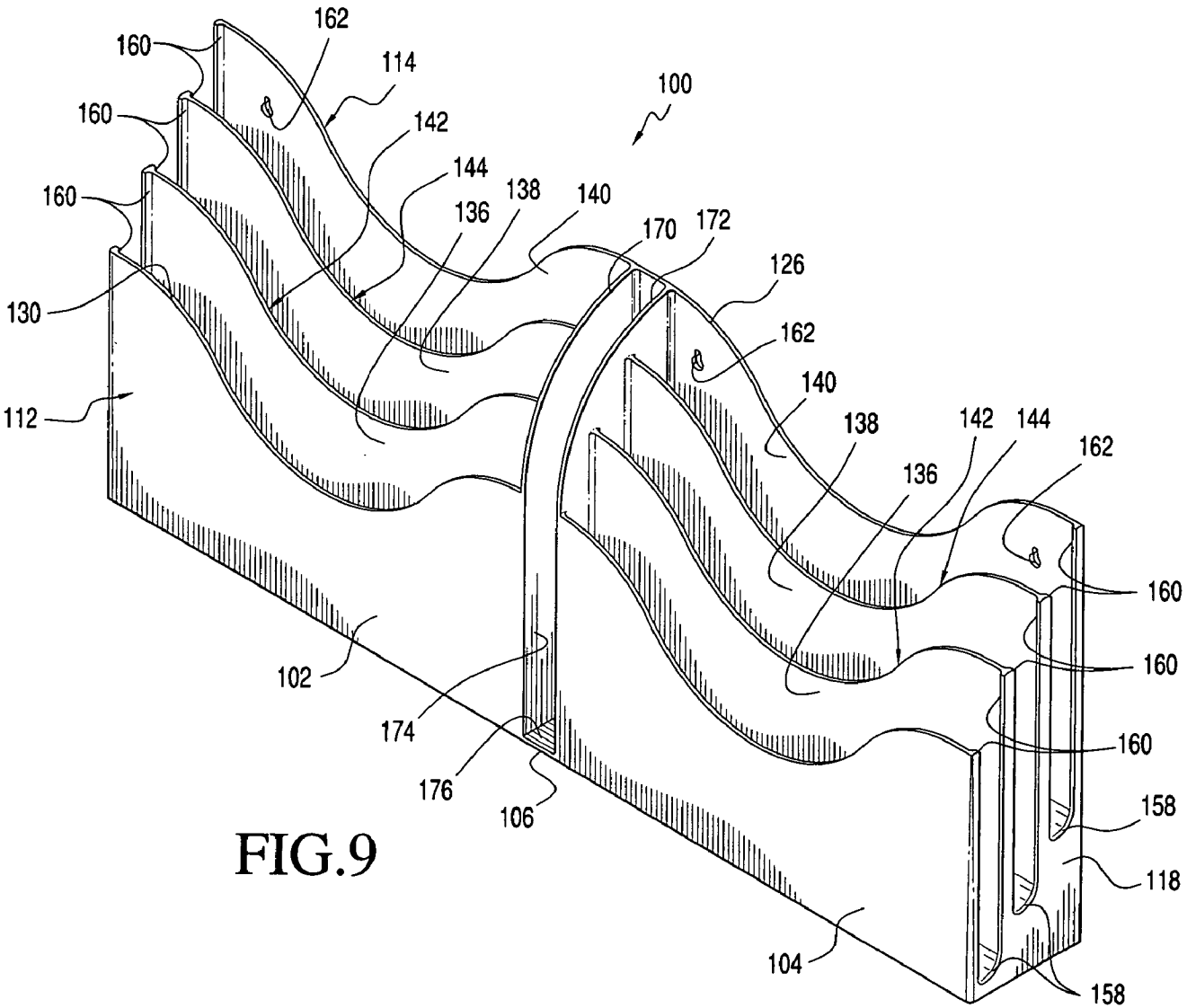
FIG. 9 is a front, perspective view of a second embodiment of a file folder sorter/organizer according to the present invention shown in a vertical position in which it could be used resting on a horizontal surface, such as a desk or table top, and/or placed against a wall.
Figures 10, 11, 12:
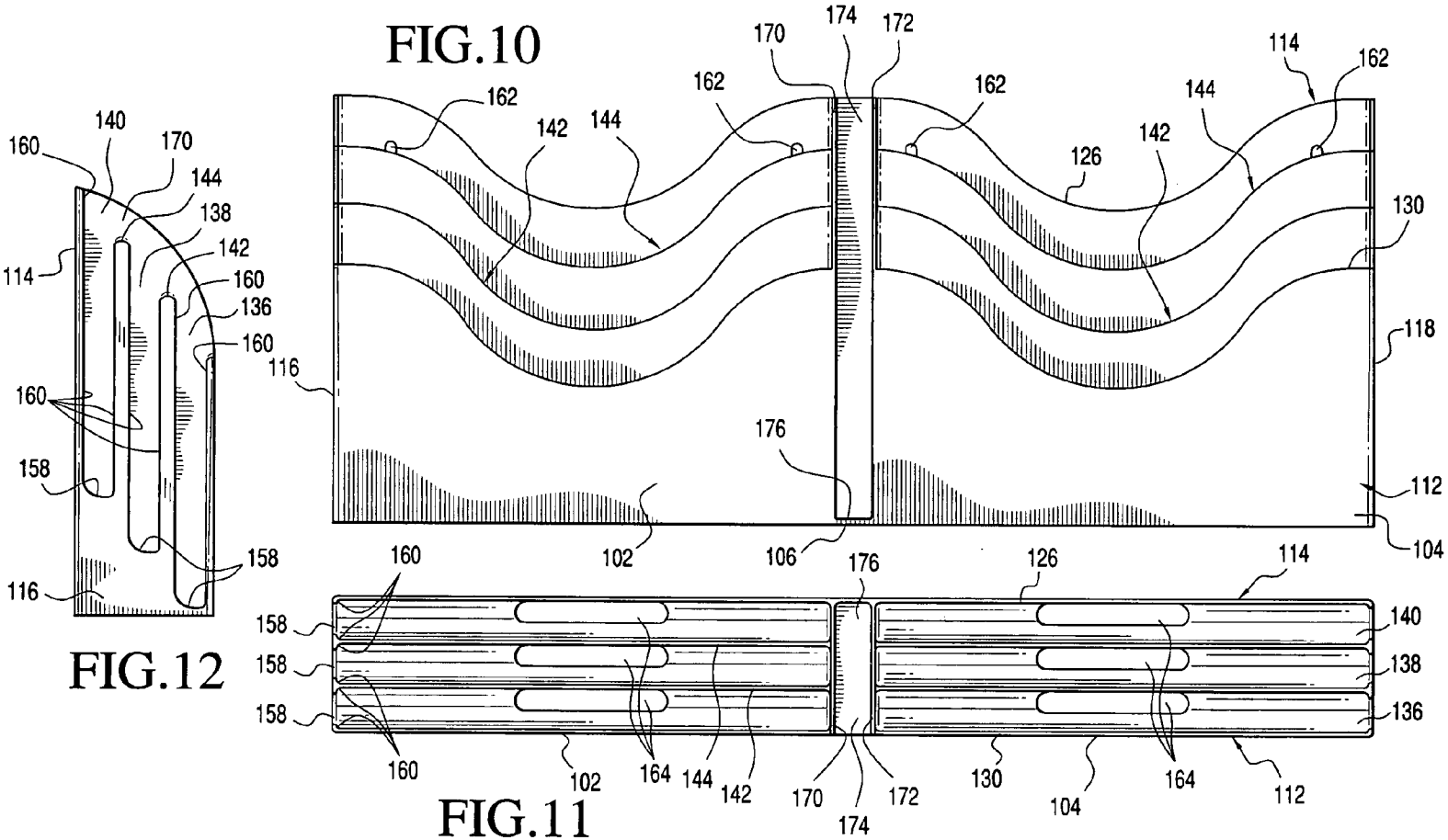
FIG. 10 is a front elevational view of the file folder sorter/organizer shown in FIG. 9.
FIG. 11 is a top plan view of the file folder sorter/organizer shown in FIG. 9.
FIG. 12 is a left side elevational view of the file folder sorter/organizer shown in FIG. 9, the right side elevational view being a mirror image thereof.
Figure 13:
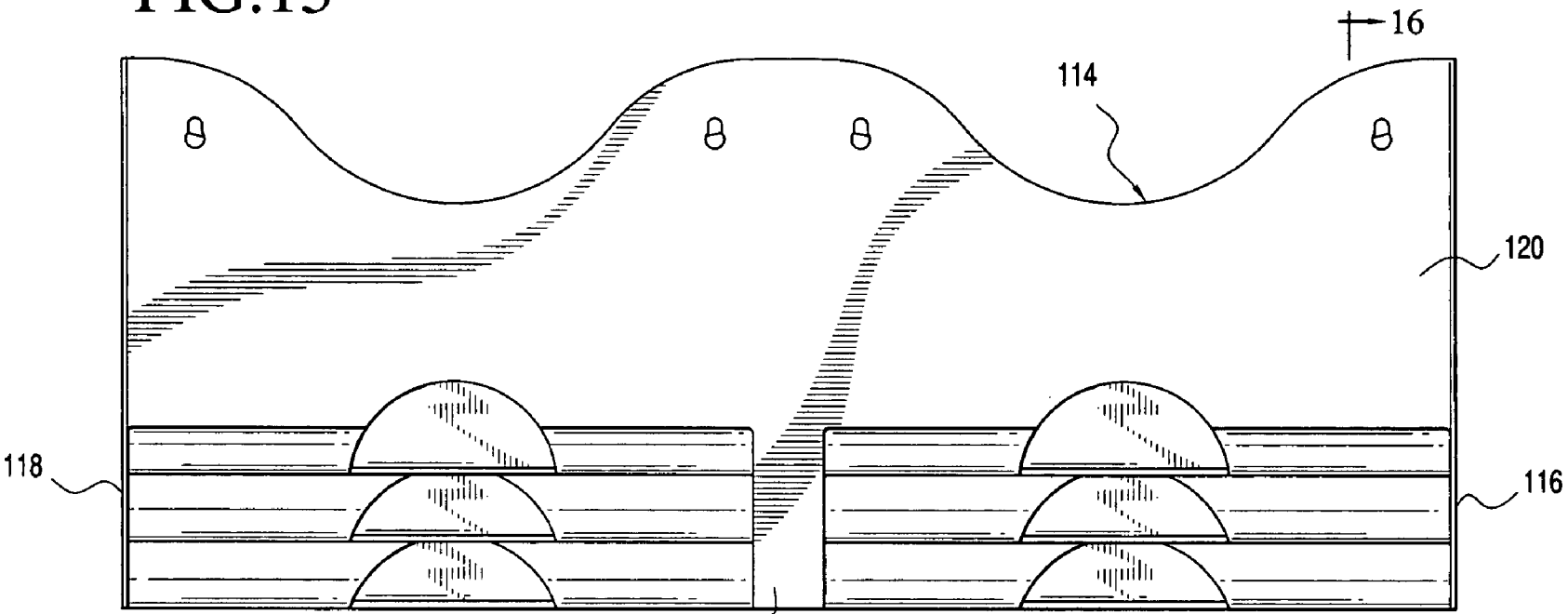
FIG. 13 is a rear elevational view of the file folder sorter/organizer shown in FIG. 9.
Figure 14:
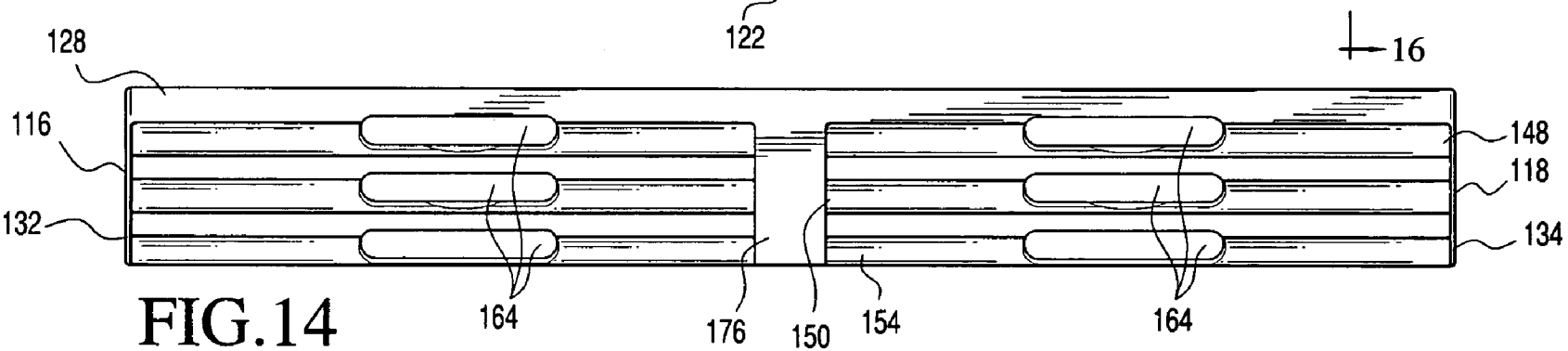
FIG. 14 is a bottom plan view of the file folder sorter/organizer shown in FIG. 9.
Figure 15:
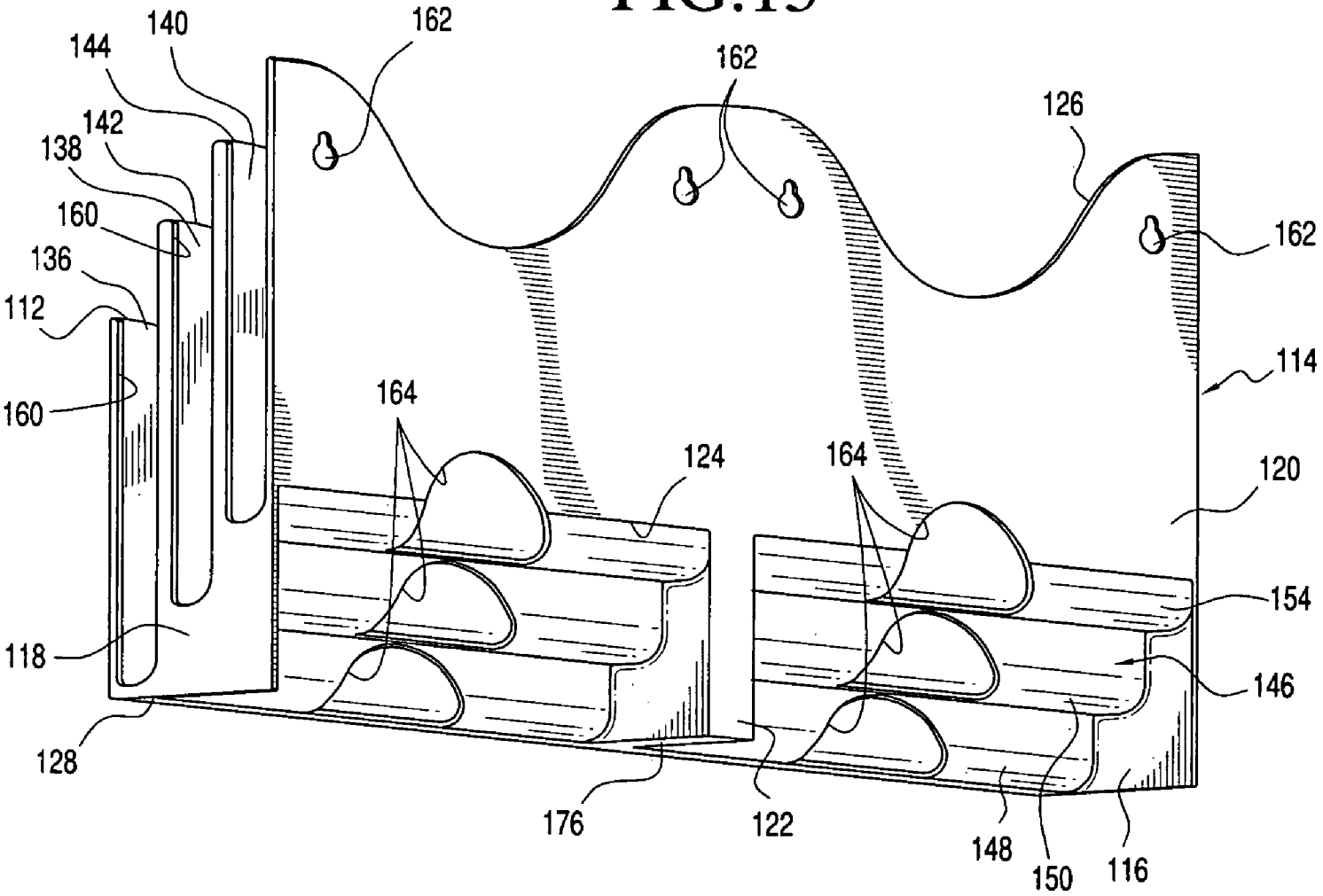
FIG. 15 is a rear, perspective view of the file folder sorter/organizer shown in FIG. 9.
Figure 16:
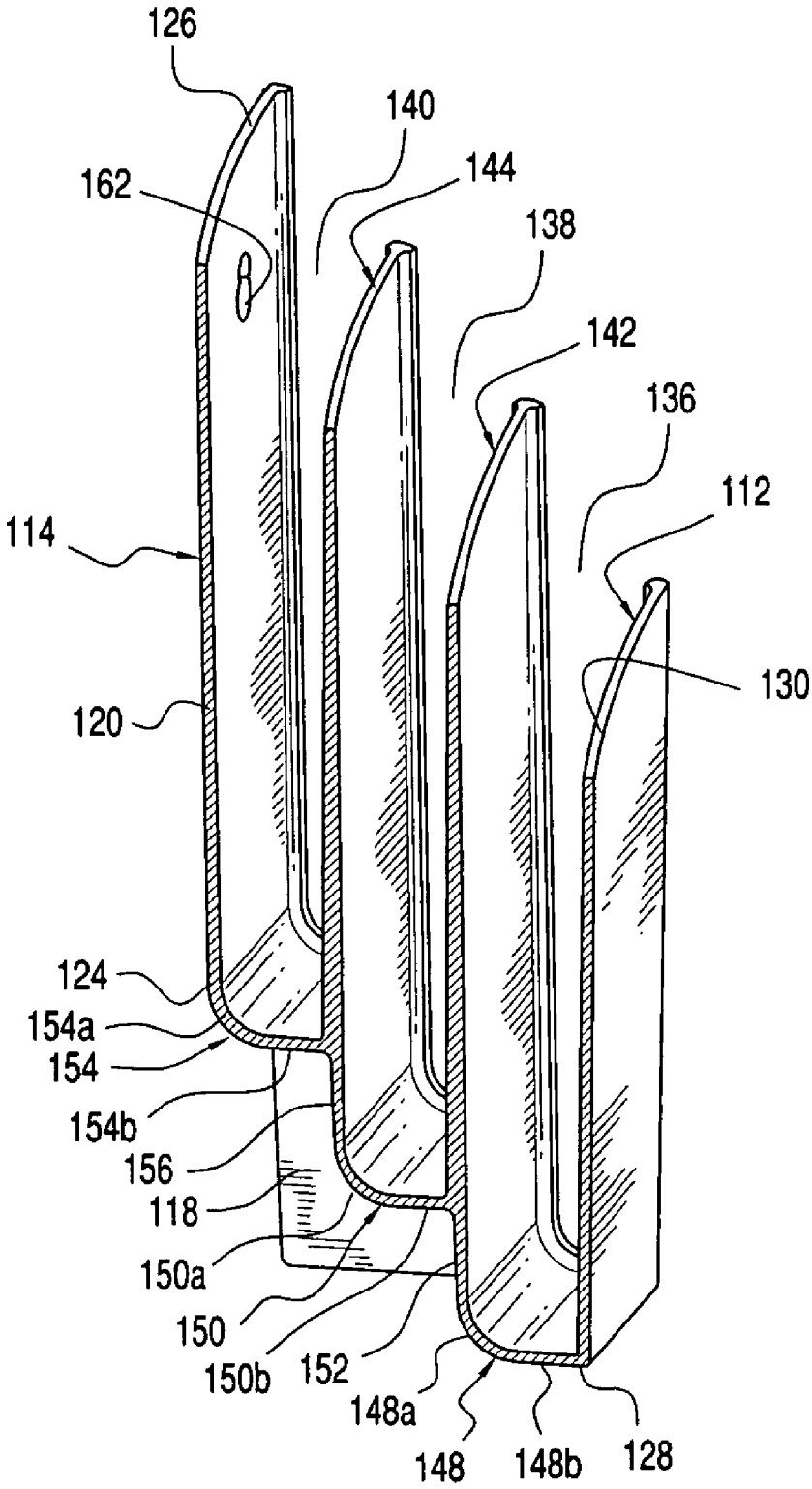
FIG. 16 is a cross-sectional, perspective view taken along the line 16—16 in FIG. 13.

Sorter/organizer 10 further includes, as best seen in FIGS. 7 and 8, a bottom wall 46 which is stepped, i.e, includes different portions at different heights and is connected to upper edge portions of the side walls 16, 18. Specifically, as seen in FIG. 8, bottom wall 46 includes a first bottom panel 48 having an arcuate portion 48*a* and a substantially flat or planar portion 48*b* forward of the arcuate portion 48*a* and preferably coplanar with the lower edge 28 of the front wall 12. In this case, the planar portion 48*b* of the first bottom panel 48 would rest on the desktop or other flat surface when sorter/organizer 10 is vertically oriented thereon and thereby the portion 48*b* of the first bottom panel 48 would further support the sorter/organizer 10.

The bottom wall 46 also includes a second bottom panel 50 which is raised relative to the first bottom panel 48 and which is rearwardly offset therefrom. Second bottom panel 50 has an arcuate portion 50*a* and a substantially flat or planar portion 50*b* forward of the arcuate portion 50*a* and substantially parallel to the planar portion 48*b* of the first bottom panel 48. A rear edge of the first bottom panel 48 (and specifically of the arcuate portion 48*a* thereof) is connected to a front edge of the second bottom panel 50 by means of a first substantially vertical rear closure panel 52 which is substantially parallel to rear wall 14 but offset forwardly therefrom. The first rear closure panel 52 is also part of the bottom wall 46.

Bottom wall 46 also includes a third bottom panel 54 which is raised relative to the second bottom panel 50 and which is rearwardly offset therefrom. Third bottom panel 54 has an arcuate portion 54*a* and a substantially flat or planar portion 54*b* forward of the arcuate portion 54*a* and substantially parallel to the flat or planar portion 48*b* of the first bottom panel 48 and to the flat or planar portion 50*b* of the second bottom panel 50. A rear edge of the second bottom panel 50 (and specifically of the arcuate portion 50*a* thereof) is connected to a front edge of the third bottom panel 54 by means of a second substantially vertical rear closure panel 56 which is substantially parallel to rear wall 14 and positioned between rear wall 14 and first rear closure panel 52. The second rear closure panel 56 is also part of the bottom wall 46.

Bottom panels 48, 50 and 54 define the bottom support surface of compartments 36, 38 and 40, respectively, which is designed to support file folders and the like. An advantage obtained by providing the arcuate portion of each bottom panel rearward of the substantially planar portion thereof is that when a file folder or the like is inserted into the compartment, for example against the rear wall defining the compartment, as it engages the arcuate portion, it will slide along the arcuate portion onto the substantially planar portion of the bottom panel of that compartment and rest with its bottom on the substantially planar portion. Regardless of how it is inserted into the compartment, the file folder would thus be conveniently positioned in a position in which it leans backward against the rear wall defining the compartment, and thereby provide easier storage, sorting and viewing of the file and its contents.

Nevertheless, instead of bottom panels having an arcuate portion and a planar portion, it is conceivable to construct the bottom panels to be entirely planar (such as disclosed in U.S. Pat. No. 5,826,730) or entirely arcuate so long as the inner surface of the bottom panels provides an appropriate support surface for file folders and the like.

The compartments 36, 38, 40 are not limited lengthwise by the side walls 16, 18 since the compartments 36, 38, 40 are defined only by the front wall 12, the rear wall 14, the dividing walls 42, 44 and the bottom wall 46. By maintaining the sides of the compartments 36, 38, 40 open, it becomes possible to place file folders and other objects having a length larger than the length of the compartments 36, 38, 40 therein. Such larger objects will extend past the edges of the walls 12, 14, 42 and 44. This provides a significant advantage over prior art constructions in which the compartments were limited lengthwise by side walls or transverse dividing walls.

Although the sides of the compartments 36, 38, 40 are open, it is nevertheless beneficial to include some form of a retaining structure in the sorter/organizer 10 which is designed to prevent file folders and other objects from inadvertently slipping out of the compartments 36, 38, 40. To this end, ledges or lips 58 are formed integral with the side walls 16, 18 and extending above the upper edge of the side walls 16, 18. The ledges 58 are arranged alongside the bottom panels 48, 50 and 54 and extend upward to a height (for example, about 1/16 to about 1/4 inch) above the bottom of the compartments 36, 38, 40. However, the height of the ledges 58 is considerably smaller than the height of the front, rear and dividing walls 12, 14, 42, 44, i.e., the ledges 58 extend only partially toward the upper edges of the front, rear and dividing walls 12, 14, 42, 44, so that the sides of the compartments 36, 38, 40 are almost completely open.

To strengthen the front wall 12, rear wall 14 and dividing walls 42, 44, reinforcing ribs 60 are provided integral therewith and with the side walls 16, 18. The reinforcing ribs 60 also preferably extend along the first and second rear closure panels 52, 56 of the bottom wall 46 to be contiguous with the ledges 58. The formation of the reinforcing ribs 60 on only the inward side of the front and rear walls 12, 14 provides these walls with an L-shaped termination while the formation of the reinforcing ribs 60 on both sides of the dividing walls 42, 44 provides these walls with a T-shaped termination (see FIG. 3).

The ledges 58 prevent slipping of file folders from the compartments 36, 38, 40 (when the file folders are lengthwise smaller than the compartments 36, 38, 40) because the file folder would rest on one of the bottom panels 48, 50 and 54 and if moved laterally toward a side of the compartment 36, 38, 40, the bottom of the file folder would contact an adjacent portion of the ledge 58. In a similar manner, the reinforcing ribs 60 could also prevent slipping of file folders from the compartments 36, 38, 40 because if the sides of the file folders rest against the front wall 12, rear wall 14 and/or dividing walls 42, 44, movement of the sides of the file folders laterally would result in the sides of the file folders contacting the reinforcing ribs 60. As such, the ledges 58 and reinforcing ribs 60, considered individually or in combination, are effective to prevent the file folder from inadvertently laterally moving out of the respective compartment 36, 38, 40.

With the foregoing arrangement, because of the offset of front and rear walls 12 and 14, and because of the staggered relation of bottom panels 48, 50, 54, compartments 36, 38 and 40 are staggered in height. By providing the front wall 12, the rear wall 14 and the dividing walls 46 and 48 with substantially the same height, the absolute height of each compartment 36, 38, 40 is substantially the same, so that equal size file folders placed in the compartments will be staggered vertically for easy viewing and accessibility. At the same time, however, due to the support provided by the side walls 16 and 18 and the rear wall 14, i.e., since the lower edges 24 of the support portions 22 of the rear wall 14 and the lower edges 32, 34 of the side walls 16,18 are co-planar with the lower edge 28 of the front wall 12, sorter/organizer 10 can sit on its own (i.e., it can be free standing) on a desktop in a vertical orientation, while the stepped arrangement of the bottom wall 46 is hidden from view by the side walls 16 and 18.

To enable the sorter/organizer 10 to be hung on a wall or other vertical surface, the upper end of rear wall 14 is provided with two holes or openings 62 (preferably keyhole shaped) on opposite sides thereof for receiving screws or nails in a wall. Another use would be to orient the sorter/organizer 10 such that the rear wall 14 rests on a horizontal surface such as a desktop in which case, the rear wall 14 (and rear edges of side walls 16 and 18 when the optional supports portions 22 of the rear wall 14 are not present) support sorter/organizer 10 on the desktop. In such a case, the file folders will be oriented horizontally, but will still be staggered for easy reading.

The sorter/organizer 10 can be fabricated from a relatively simple two-piece mold, with only one cam action portion for forming the keyholes 62. One portion of the mold defines the outer surface configuration of the sorter/organizer. A second portion of the mold has elongated tongue-like members which are inserted into the main portion of the mold and which define the spaces 36, 38 and 40 between the dividing walls 42, 44 and the walls 12 and 14. However, during molding, and injection of the plastic material, the forces are very high and tend to cause the tongue-like members which form the compartments 36, 38, 40 to be undesirably moved or dislodged. Therefore, the main portion of the mold preferably includes openings therein, and the tongue-like members forming compartments 36, 38, 40 have projections thereon which engage the openings in the main portion of the mold, to stabilize the tongue-like members to prevent movement thereof during the molding process. As a result, openings 64 are formed in the rear wall 14 and the bottom wall 46 (see FIGS. 5–7). The openings 64 enable stabilizing of the mold, and also results in a lighter product since less plastic is used. Moreover, since file folders or the like are intended to be stored in the sorter/organizer, there is no disadvantage to having the relatively small openings 64 in the rear wall 14 and in the bottom wall 46.

In the event that water or other liquid falls into any of the compartments 36, 38, 40, openings 64 allow the liquid to drain out of the compartments 36, 38, 40.

Referring now to FIGS. 9–16, a second embodiment of a file folder sorter/organizer in accordance with the invention is designated generally as 100 and includes a substantially planar front wall 112, a substantially planar rear wall 114 and two side walls 116 and 118 which connect front wall 112 and rear wall 114 together in parallel, spaced apart relation. The rear wall 114 has a compartment-defining portion 120 and a support portion 122 arranged below the compartment-defining portion 120. The compartment-defining portion 120 of the rear wall 14 has a lower edge 124 staggered or raised with respect to a lower edge 128 of the front wall 112, for example, by about 3 inches relative to the lower edge 128 of the front wall 112, and its upper edge 126 also raised relative to the upper edge 130 of front wall 112.

The lower edge of the support portion 122 of the rear wall 114, the lower edge 128 of the front wall 112 and the lower edges 132, 134 of the side walls 116, 118 are substantially flat to enable the sorter/organizer 100 to securely rest on a desktop, or other flat surface, when vertically oriented thereon. To provide further support for the sorter/organizer in a vertical orientation, it is possible to position the sorter/organizer 100 with the rear wall 114 against a vertical surface such as a wall. This provides further stability to the sorter/organizer 100, but it still remains possible to use the sorter/organizer 100 in a free standing position without placing it against a vertical wall or other vertical surface.

The front wall 112 is partitioned into two front wall portions 102, 104 separated by an intermediate connecting portion 106. Two substantially planar dividing walls 142, 144 are arranged between each front wall portion 104 and the rear wall 114 to thereby divide the area between the front and rear walls 112 and 114 into compartments 136, 138, 140. The spaced apart, widthwise dividing walls 142 and 144 extend between front and rear walls 112 and 114 and in parallel relation thereto.

Two spaced-apart transverse walls 170, 172 connect inner edges of the front wall portions 102, 104 to the rear wall 114 such that a vertically oriented storage compartment 174 is defined by the rear wall 114, the transverse walls 170, 172 and a bottom wall 176. Bottom wall 176 extends between the connecting portion 106 of the front wall 112 and the support portion 122 of the rear wall 114. Storage compartment 174 can be used to store envelopes and other similar objects. More than two transverse walls 170, 172 can be provided, to produce additional storage compartments 174, preferably adjacent each other.

The sorter/organizer 100 has essentially a mirror-image construction about a mid-plane transecting the storage compartment 174. Therefore, a description of only one set of compartments 136, 138, 140 defined by the front wall portion 102, the transverse wall 170 and the rear wall 114 will be provided, it being understood that the other set of compartments 136, 138, 140 defined by the front wall portion 104, the transverse wall 172 and the rear wall 114 is the same.

Sorter/organizer 100 further includes a bottom wall 146 which is stepped (see FIGS. 13–17). Specifically, bottom wall 146 includes a first bottom panel 148 having an arcuate portion 148*a* and a substantially flat or planar portion 148*b* that is preferably coplanar with the lower edge 128 of the front wall 112. The bottom wall 146 also includes a second bottom panel 150 which is raised relative to the first bottom panel 148 and which is rearwardly offset therefrom. Second bottom panel 150 has an arcuate portion 150*a* and a substantially flat or planar portion 150*b* substantially parallel to the planar portion 148*b* of the first bottom panel 148. A rear edge of the first bottom panel 148 (and specifically of the arcuate portion 148*a* thereof) is connected to a front edge of the second bottom panel 150 by means of a first rear closure panel 152 which is parallel to rear wall 114 but offset forwardly therefrom.

Bottom wall 146 also includes a third bottom panel 154 which is raised relative to the second bottom panel 150 and which is rearwardly offset therefrom. Third bottom panel 154 has an arcuate portion 154*a* and a substantially flat or planar portion 154*b* substantially parallel to the flat or planar portion 148*b* of the first bottom panel 148 and to the planar portion 150*b* of the second bottom panel 150. A rear edge of the second bottom panel 150 (and specifically of the arcuate portion 150*a* thereof) is connected to a front edge of the third bottom panel 154 by means of a second substantially vertical rear closure panel 156 which is substantially parallel to rear wall 114 and positioned between rear wall 114 and first rear closure panel 152.

Bottom panels 148, 150 and 154 define the bottom support surface of compartments 136, 138 and 140, respectively, which is designed to support file folders and the like. Instead of bottom panels having an arcuate portion and a substantially flat or planar portion, it is conceivable to construct the bottom panels to be entirely planar (such as disclosed in U.S. Pat. No. 5,826,730) or entirely arcuate so long as the inner surface of the bottom panels provides an appropriate support surface for file folders and the like.

On an outer side, the compartments 136, 138, 140 are not limited lengthwise by the side walls 116, 118 although they are limited on an inner side by the transverse walls 170, 172 extending rearward from the inner edges of the front wall portions 102, 104. By maintaining the outer side of the compartments 136, 138, 140 open, it becomes possible to place file folders and other objects having a length larger than the length of the compartments 136, 138, 140 therein.

Although the outer side of the compartments 136, 138, 140 is open, the same retaining structure described above can be included to prevent file folders and other objects from inadvertently slipping out of the compartments 136, 138, 140. To this end, ledges 158 are formed integral with the side walls 116, 118 and extend above the upper edge portions of the side walls 116, 118. The ledges 158 are arranged alongside the bottom panels 148, 150 and 154 and extend upward to a height (for example, about 1/16 to about 1/4 inch) above the bottom of the compartments 136, 138, 140. However, the height of the ledges 158 is considerably smaller than the height of the front, rear and dividing walls 112, 114, 144, 146 so that the sides of the compartments 136, 138, 140 above the ledges 158 are almost completely open.

To strengthen the front wall portions 102, 104, rear wall 114 and dividing walls 142, 144, reinforcing ribs 160 are provided on an outer edges thereof and integral therewith and with the side walls 116, 118. The reinforcing ribs 160 also preferably extend along the outer edges of the first and second rear closure panels 152, 156 of the bottom wall 146 to be contiguous with the ledges 158. The formation of the reinforcing ribs 160 on only the inward side of the front and rear walls 112, 114 provides these walls with an L-shaped termination while the formation of the reinforcing ribs 160 on both sides of the dividing walls 142, 144 provides these walls with a T-shaped termination (see FIGS. 11 and 16).

The ledges 158 prevent slipping of file folders from the outer side of the compartments 136, 138, 140 (when the file folders are lengthwise smaller than the compartments 136, 138, 140) because the file folder would rest on one of the bottom panels 148, 150 and 154 and if moved laterally toward a side of the compartment 136, 138, 140, the bottom and/or sides of the file folder would contact an adjacent portion of the ledge 158 or reinforcing rib 160.

The same placement and mounting variations described for sorter/organizer 10 apply to sorter/organizer 100 as well, including the presence of mounting holes 162 on the rear wall 114 to enable the sorter/organizer to be mounted to a wall or other vertical surface and the possibility of orienting the sorter/organizer 100 horizontally so that it rests on the rear wall 114.

The same fabrication method described above for sorter/organizer 10 can be applied to fabricate sorter/organizer 100. Thus, the sorter/organizer would include openings 164 in the rear wall 114 and the bottom wall 146 (see FIGS. 13 and 14)

which enable reducing the weights of the resulting product and stabilizing of the mold during molding, to thereby produce products with better dimensional accuracy.

Thus, disclosed above are two embodiments of a file folder sorter/organizer in accordance with the invention in which there are staggered and stepped compartments and in which there is no limit on the size of the file folders or other objects which can be placed into the compartments. Moreover, file folders and other objects stored in the compartments are prevented from falling out of the compartments in view of the presence of the ledges and reinforcing ribs. A wider construction also enables an additional intermediate storage compartment to be defined, as in FIGS. 9–16, which may be used to store envelopes, writing utensils and the like. If desired, multiple intermediate storage compartments can be defined between the file folder compartments. The sorter/organizers of the present invention are preferably injector molded from plastic materials, such as, for example, styrene, ABS, polypropylene, etc.

It should be clear that various modifications and alterations can be made within the scope of the present invention. Also, various features of one embodiment can be combined with features of other embodiments, consistent with proper operation thereof, within the scope of the present invention.

I claim:

1. A sorter/organizer, comprising:

at least three substantially planar walls arranged substantially parallel to one another;

side walls connected to said at least three walls;

a first, stepped bottom wall connected to at least three of said walls and at least one of said side walls, at least two compartments being formed each by an adiacent pair of said at least three walls and said first bottom wall, said compartments being staggered in relation to one another and receivable of objects, said at least one side wall being arranged to enable a bottom of said compartments to be positioned at varied heigths, said at least one of said side walls having upper edge portions connected to said first bottom wall; and a plurality of ledges, each of said ledges being arranged at a respective end of one of said compartments, each of said ledges extending above said upper edge portion of said side wall at the respective end of said one of said compartments only partially along a heigth of said adjacent pair of said at least three walls forming said compartment such that at least one side of said compartment is open above said ledges to enable objects received in said compartment to extend laterally outward therefrom above said ledge and such that an upper surface of said ledge is above a bottom of said compartment to prevent objects received in said compartment and contacting the bottom of said compartment from inadvertently slipping out therefrom.

2. The sorter/organizer of claim 1, wherein said first bottom wall includes an arcuate portion and a substantially flat or planar portion forward of said arcuate portion defining the bottom of at least one of said compartments whereby an object contacting said arcuate portion slides forward along said arcuate portion onto said substantially flat or planar portion.

3. The sorter/organizer of claim 1, wherein said first bottom wall includes a plurality of bottom panels arranged at different heights and closure panels connecting adjacent ones of said bottom panels, each of said bottom panels defining a bottom support surface of a respective one of said compartments, said closure panels being substantially parallel to said at least three walls.

4. The sorter/organizer of claim 3, wherein said ledges are arranged alongside said bottom panels.

5. The sorter/organizer of claim 1, wherein said first bottom wall is connected to two said side walls.

6. The sorter/organizer of claim 1, further comprising reinforcing ribs arranged on at least one side of said at least three walls and contiguous with one of said side walls and said ledges such that said reinforcing ribs have a surface coplanar with an outer surface of said side walls.

7. The sorter/organizer of claim 6, wherein said at least three walls include a front wall, a rear wall and at least one dividing wall arranged between said front wall and said rear wall and said reinforcing ribs extend inward from each of said at least three walls toward an opposed one of said at least three walls such that outer edges of said front wall and said rear wall are provided with an L-shaped reinforcing structure and an outer edge of each of said at least one dividing wall is provided with a T-shaped reinforcing structure at said at least one side of said at least three walls.

8. The sorter/organizer of claim 1, wherein said at least three walls include a front wall, a rear wall and at least one dividing wall arranged between said front wall and said rear wall.

9. The sorter/organizer of claim 8, wherein said rear wall includes a compartment-defining portion and support portions each arranged below said compartment-defining portion and contiguous with a respective one of said side walls, a lower edge of each of said support portions being co-planar with lower edges of said front wall and said side walls, said compartment-defining portion having a lower edge staggered or raised with respect to the lower edge of said front wall and an upper edge raised relative to an upper edge of said front wall.

10. The sorter/organizer of claim 8, wherein said at least one dividing wall includes first and second dividing walls such that a first compartment is defined between said front wall and said first dividing wall, a second compartment is defined between said first dividing wall and said second dividing wall and a third compartment is defined between said second dividing wall and said rear wall.

11. The sorter/organizer of claim 8, wherein said front wall includes first and second spaced-apart front wall portions, said at least one dividing wall comprising a plurality of dividing walls, at least of one of said plurality of dividing walls being arranged between each of said front wall portions and said rear wall to thereby define at least one compartment between each of said front wall portions and said rear wall, further comprising:

at least first and second transverse walls extending rearward from inner edges of said front wall portions such that a storage compartment is defined between said transverse walls, said first bottom wall being connected to said first transverse wall, said first front wall portion, said rear wall and a first one of said side walls, said first side wall extending rearward from an outer edge of said first front wall portion; and a second, stepped bottom wall connected to said second transverse wall, said second front wall portion, said rear wall and a second one of said side walls, said second side wall extending rearward from an outer edge of said second front wall portion.

12. The sorter/organizer of claim 11, wherein said transverse walls are parallel to said side walls.

13. The sorter/organizer of claim 11, wherein said transverse walls connect said front wall portions to said rear wall such that said transverse walls and said side walls have substantially the same depth.

14. The sorter/organizer of claim 11, further comprising a substantially flat or planar bottom wall arranged between said transverse walls to define a bottom of said storage compartment.

15. The sorter/organizer of claim 14, wherein said front wall includes a connecting portion arranged between said first and second front wall portions, said substantially flat or planar bottom wall being connected to said connecting portion of said front wall.

16. The sorter/organizer of claim 11, wherein said rear wall includes a compartment-defining portion and a support portion arranged below said compartment-defining portion, said compartment-defining portion having a lower edge staggered or raised with respect to a lower edge of said front wall, a lower edge of said support portion being co-planar with lower edges of said front wall and said side walls.

17. The sorter/organizer of claim 11, wherein each of said first and second bottom walls includes an arcuate portion and a substantially flat or planar portion forward of said arcuate portion defining the bottom of at least one of said compartments whereby an object contacting said arcuate portion slides forward along said arcuate portion onto said substantially flat or planar portion.

18. The sorter/organizer of claim 11, wherein each of said first and second bottom walls includes a plurality of bottom panels arranged at different heights and closure panels connecting adjacent ones of said bottom panels, each of said bottom panels defining a bottom support surface of a respective one of said compartments, said closure panels being substantially parallel to said at least three walls.

19. The sorter/organizer of claim 18, wherein said ledges are arranged alongside said bottom panels.

20. The sorter/organizer of claim 11, further comprising reinforcing ribs arranged on an outer edge of each of said at least three walls and contiguous with one of said side walls and said ledges such that said reinforcing ribs have a surface substantially coplanar with an outer surface of said side walls.

21. The sorter/organizer of claim 20, wherein said reinforcing ribs extending inward from each of said at least three walls toward an opposed one of said at least three walls such that outer edges of said front wall and said rear wall are provided with an L-shaped reinforcing structure and outer edges of each of said at least one dividing wall are provided with a T-shaped reinforcing structure.

22. The sorter/organizer of claim 1, wherein said side walls each have a lower edge substantially coplanar with a lower edge of said front wall.

23. The sorter/organizer of claim 1, wherein said ledges extend from about 1/16 inch to 1/4 inch above the bottom of said compartments.

* * * * *